US005327747A

United States Patent [19]

Aria

[11] Patent Number: 5,327,747

[45] Date of Patent: Jul. 12, 1994

[54] DEVICE FOR AXIALLY SHIFTING WITHIN A CIRCULAR KNITTING MACHINE THOSE NEEDLES WHICH HAVE NOT BEEN RAISED BY JACKS

[75] Inventor: Piero Aria, Florence, Italy

[73] Assignee: Savio S.p.A., Pordenone, Italy

[21] Appl. No.: 983,827

[22] Filed: Dec. 1, 1992

[30] Foreign Application Priority Data

Dec. 3, 1991 [IT] Italy ..... MI91 A 003239

[51] Int. Cl.[5] ..... D04B 15/32

[52] U.S. Cl. ..... 66/57; 66/219; 66/220

[58] Field of Search ..... 66/57, 78, 215, 216, 66/218, 219, 223

[56] References Cited

U.S. PATENT DOCUMENTS

| | | | |
|---|---|---|---|
| 3,240,032 | 3/1966 | Carrotte | 66/223 X |
| 3,335,581 | 8/1967 | Pernick | 66/50 |
| 3,763,667 | 10/1973 | Mishcon | 66/223 |
| 3,972,206 | 8/1976 | Mureso | 66/219 |
| 4,038,837 | 8/1977 | Güell | 66/219 |
| 4,120,177 | 10/1978 | Micheletti | 66/57 X |
| 4,151,729 | 5/1979 | Micheletti | 66/216 |
| 4,905,484 | 3/1990 | Schindler | 66/220 |
| 5,184,485 | 2/1993 | Bini | 66/57 X |

FOREIGN PATENT DOCUMENTS

| | | | |
|---|---|---|---|
| 2138963 | 10/1972 | Fed. Rep. of Germany . | |
| 3507496 | 9/1986 | Fed. Rep. of Germany | 66/57 |
| 2359225 | 2/1978 | France . | |
| 2177427 | 1/1987 | United Kingdom . | |
| 2184752 | 7/1987 | United Kingdom . | |

*Primary Examiner*—Andrew M. Falik
*Assistant Examiner*—John J. Calvert
*Attorney, Agent, or Firm*—George P. Hoare, Jr.

[57] ABSTRACT

A circular knitting machine having a needle selection device and a device for axially shifting needles which has an axially movable cam. The axially movable cam defines a contour and is movable to three levels corresponding to a knitting position, a tuck position, and a float position. The device is arranged in correspondence with the feed stations of a circular knitting machine, such that butts of needles not moved into operation by jacks traverse the contour of the axially movable cam. The contour raises the needles not moved into operation by the jacks with a substantial delay with respect to other needles moved into operation by the jacks under control of the needle selection device.

4 Claims, 5 Drawing Sheets

DEVICE FOR AXIALLY SHIFTING WITHIN A CIRCULAR KNITTING MACHINE THOSE NEEDLES WHICH HAVE NOT BEEN RAISED BY JACKS

FIELD OF THE INVENTION

This invention relates to circular knitting machines and in particular to the control of needles in such machines for the purpose of producing patterned or reinforced knitwork, and provides a device and method for shifting those needles which are to seize the yarn from the various feed stations to form knitwear. Circular knitting machines consist generally of one or two needle cylinders having grooves or tricks formed in their outer cylindrical surface.

BACKGROUND OF THE INVENTION

The tricks slidably accommodate and guide needles which during their vertical travel, form the stitch loops in cooperation with the sinkers.

The number of tricks is equal to the number of needles which slide in them with reciprocating movement by the effect of raising and lowering cams.

Generally, in hosiery machines the number of tricks and needles is between 200 and 400.

The cylinder is rotated and with it there rotate the needles which, during their reciprocating movement, are fed with yarn. The yarn is fed at angular positions, when the needles reach their highest point of travel, by feed stations. The feed stations consist of one or more yarn guides which are selectively presented to the needle hooks so that the needles seize the yarn from the guides.

To produce hosiery articles, generally only a fraction of the available needles are used at the same time and in the same manner, except for the plain knitwork parts of the hose. During the formation of the plain knitwork, all the needles are operated between their maximum and minimum level, all needles are fed with yarn at each knitting course, and all of the needles are moved in the same manner.

When the machine is not producing plain knitwork, in order to produce other types of knitwork some needles are required to produce stitch loops and therefore be raised to the maximum level at the feed station in order to seize the yarn. Other needles have to be raised to an intermediate level to take up yarn without clearing the previous stitch in order to form a tuck stitch, or have to be raised with a certain delay so that they do not seize the yarn fed in that feed station and therefore do not form new loops with it. In other words a needle selection has to be made. This means that before each feed, means have to be provided for determining how many needles must undergo a certain travel, which and how many other needles must undergo a certain different travel, and which needles undergo no travel.

SUMMARY OF THE INVENTION

A device is disclosed for axially shifting the needles in a circular knitting machine having a device for selecting the needles via jacks, which axially shift needles excluded from working. The needles are either shifted into a stitch unloading position (i.e. a knitting position), a tuck stitch position, or a low inactivated position, (i.e., a float position). The device comprises an axially movable cam which can be located at the three levels corresponding to the stitch unloading position, the tuck stitch position, or a low inactivated position of the needles having butts which traverse the contour of the cam. The cam is arranged in correspondence with the feed stations of the circular knitting machine. Needles having butts traversing the contour of the cam are raised with a substantial delay with respect to needles raised and put into operation by the jacks.

BRIEF DESCRIPTION OF THE DRAWINGS

Further features of the invention will be apparent from the following detailed description of a preferred embodiment thereof, and the accompanying drawings wherein.

DETAILED DESCRIPTION OF THE DRAWINGS

Figure 1:
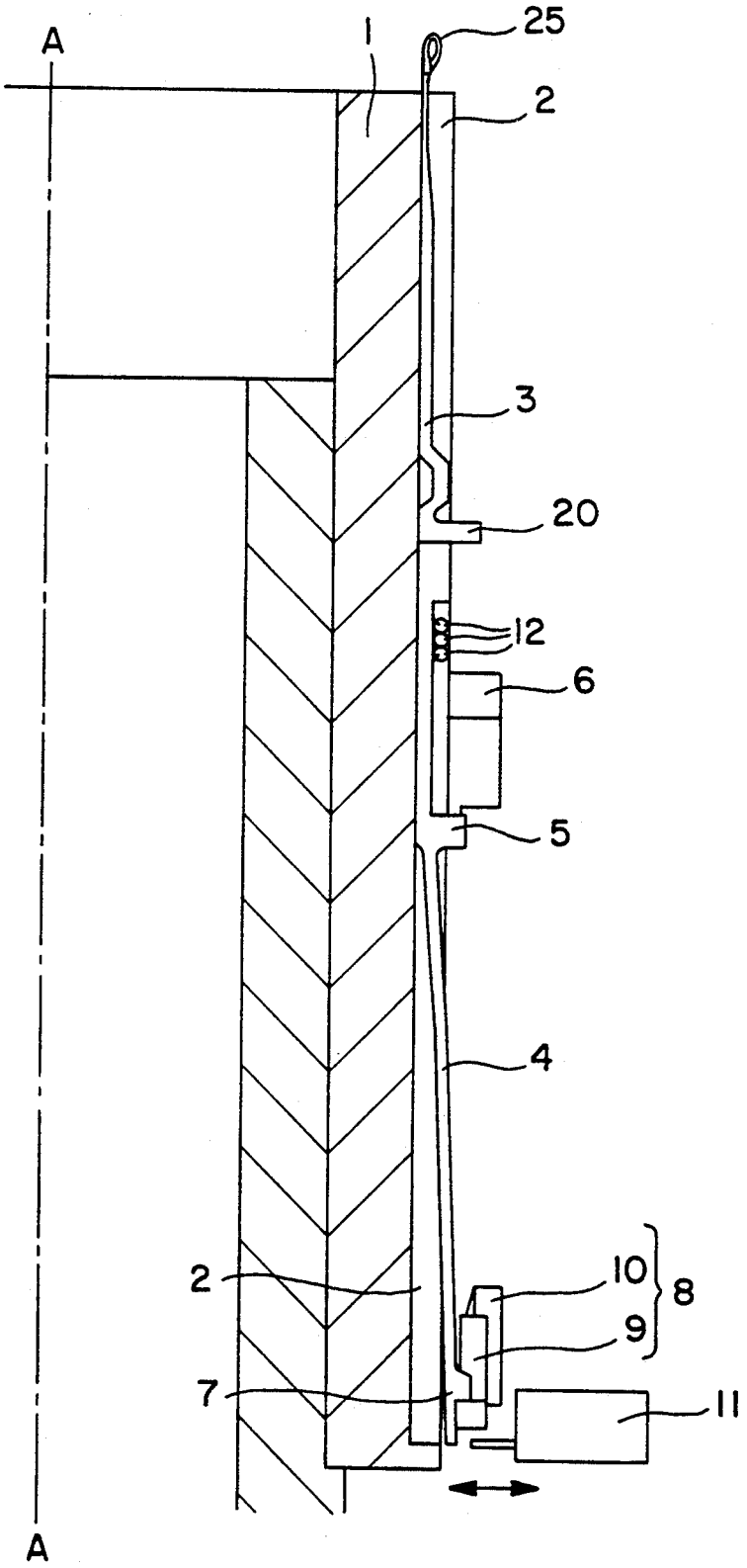
FIG. 1 PRIOR ART
FIG. 1 is a schematic fragmentary vertical sectional view of a needle selection device in a prior art circular knitting machine.

Referring to FIG. 1, needle selection is effected by the jacks 4 which slide in the same tricks 2 as the needles lying above them, to urge the needles upwards and move them to the highest level in order to seize the yarn. After seizing the yarn the needles are controlled in their reciprocating movement by their own cams and counter-cams which are fixed relative to the cylinder, but are not indicated in FIG. 1, although they are shown in the subsequent figures.

FIG. 1 shows an elastic jack 4, able to radially flex its lower end.

When the jacks 4 have put their needle into operation they withdraw from the needle butt and return downwards. If the needle, after completing its task of seizing the yarn and forming the stitch loop and therefore being at its minimum level, is not required to seize a further yarn from another feed it remains at this level until its control jack or other machine members again move it upwards.

The shank of the jack 4 comprises in its middle part a projection 5, i.e. the upper guide butt, which comes into engagement with its own control cam 6 for urging the jack downwards when it has completed its task of raising the needle 3.

Proceeding downwards along the jack shank there is a lower butt 7 which comes into engagement with the cam ring 8, provided with a raising contour 9 which raises the jack together with its overlying needle, this therefore being selected to seize the yarn, and with a cam contour 10 which with its inner face engages the vertical face of the butt 7 to urge the foot of the elastic jack 4 into the interior of the trick 2. When in this inward approach position the butt 7 cannot engage the raising contour 9 of the ring 8 and the jack remains lowered.

Obviously the lowering cams 6 and the raising and approach contours 9 and 10 are angularly offset and operate at different times on each jack.

In circular knitting machines the needle selection is generally conducted with the jacks corresponding to the needles to be raised maintained with their raising butt in an outwardly displaced position so that they are made to engage the raising contours, while the jacks corresponding to the needles not to be raised are maintained in an approach position within the trick, whether elastic jacks or conventional rigid jacks are used.

If elastic jacks are used, they tend spontaneously to urge their lower butt 7 outwards to engage the raising contour 9 and hence be raised. If however conventional jacks are used, their approach and withdrawal movement is controlled by suitably arranged cams which are fixed relative to the cylinder.

The jacks 4 are maintained in position such that the flexing or withdrawal action of their lower part does not cause their upper part to leave the trick, for example by means of one or more circular springs 12 rigid with the cylinder and surrounding its upper part. They themselves are retained in position by circumferential grooves in the cylinder, lying on the inside of the cylindrical face of the needle cylinder 1.

In FIG. 1 the selection device is schematically indicated by 11, it allowing the jack 4 to move outwards so that it rises on the cam 9, or urging it into its trick so that it remains lowered. The conventional selection system uses mechanical selectors acting on a series of intermediate butts, but this type of selection has considerable limits in terms both of operation and of the number of possible selections.

The most recent machines use electromagnetic selection devices which allow a greater selection speed and a greater number of programmable selections, with advantages in terms of machine production and the greater variety of possible patterns.

These selection devices are divided essentially into two categories, namely fixed devices which do not rotate with the cylinder and are positioned to precede each feed station, to which the jacks are presented in sequence as they rotate, and selection devices which rotate together with the cylinder (and with its jacks) and which are therefore always each in a position corresponding with the jacks and can thus act on them at any moment, rather than only during the very short time in which the jack passes in front of them. This second type of selection is also effected before the jacks pass in front of the feed stations, but there is greater freedom with regard to synchronization requirements and the available selection time, but a large number of selection actuators are required, these being equal in number to the number of needles instead of the number of feeds. Needle selection methods and devices of the two described types, operating on rigid and elastic jacks, are described in European Patent Appln. Publications No. 0 379 234, No. 0 431 674, No. 0 441 005, No. 0 479 371 and Italian Patent Appln. 22172 A/90 of the present Applicant. The present invention relates to the control of the needles in their reciprocating movement downstream of the selection station. FIGS. 2 show the configuration of the knitting cams and counter-cams within the angular sector corresponding to the gap between two successive lowering cam and counter-cam systems.

For greater clarity, those needles and jacks which assume a position perpendicular to the drawing are shown rotated through 90° from their real position.

In the case of a four-feed machine the angular gap between two cam/counter-cam systems 21 and 22 is about 90°, whereas for a two feed machine the gap is about 180°. FIGS. 2 shows downstream of the selector device the conventional movement system for the needles not activated by their jacks, the cylinder movement being from right to left.

The butt 20 of those needles which have been put into operation by their jack 4 follows the upper trajectory limited upperly by the contours of the cams 23 and 21. The needles which are raised to their maximum level produce "unloaded" stitches.

According to this current term, the stitch loop formed during the preceding travel opens the latch 28 of the needle 3 by the effect of raising the needle, and moves into its shaft. When the needle is lowered by the action of the cam 21, the loop located on the shaft recloses the latch 28 and withdraws from the needle, to hence free it.

As already stated, at their maximum level the raised needles encounter the yarn feeds and seize the yarn from that yarn guide 24 which is lowered to present its yarn to the open hooks 25 of the needles.

When the machine is producing plain knitting, for example in a stocking leg, and is not required to produce patterns or reinforcements, all the needles have to be put into operation and selection is no longer necessary.

Figure 2A:
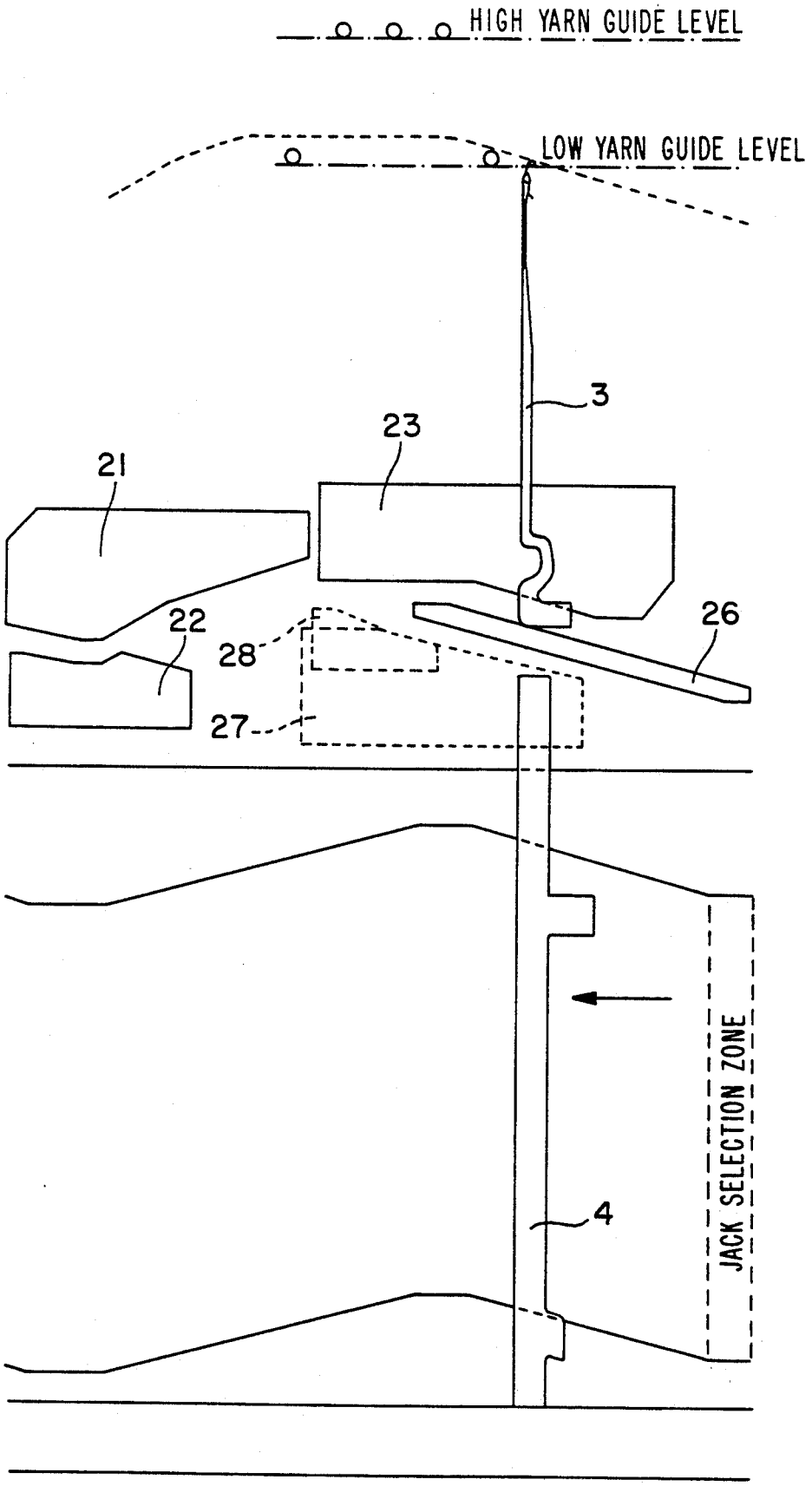
FIG. 2A PRIOR ART
FIG. 2A is a fragmentary schematic view of a prior art circular knitting machine, showing a first cam inserted for raising all of the needles.

In the known art a first raising cam 26 is then inserted and used in place of the selection device, to raise all the needles 3 by engaging their butt 20 at the exit of the cam system 21/22 (FIG. 2A).

This deactivation of the selection device allows a much greater operational speed to be attained.

By way of example, the rotation speed of a machine for women's stockings comprising four feeds can reach about 500 r.p.m. with the needle selection device engaged, but can be increased to 1000 r.p.m. and more by using the cam 26 and deactivating the selector 11.

With the cam 26 or selector 11 active, the trajectory of the butt 20 of the needles 3 is substantially the same. They travel the trajectory delimited upperly by the cams 23 and 21.

Figure 2B:
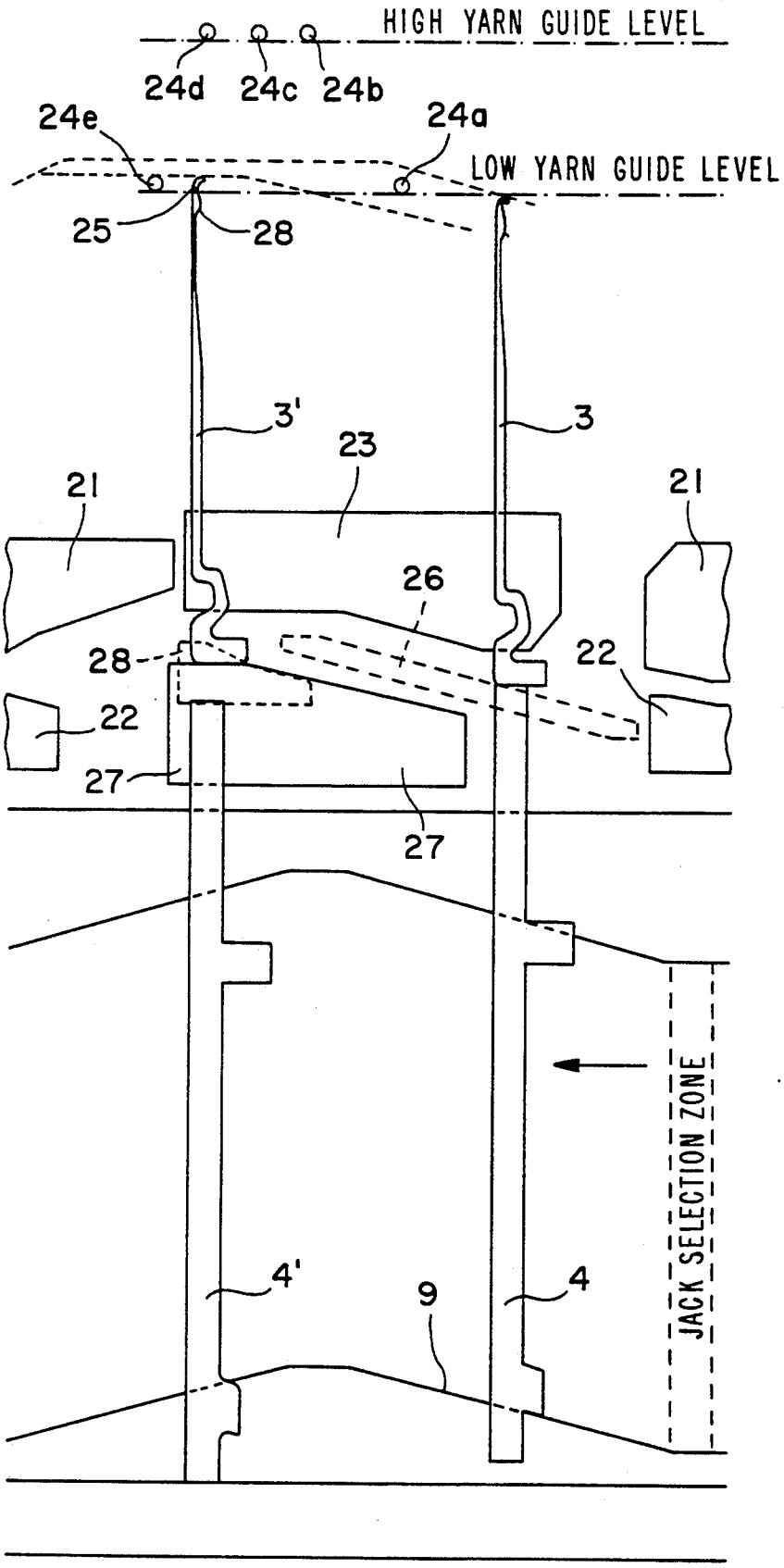
FIG. 2B PRIOR ART
FIG. 2B is a fragmentary schematic view of the prior art circular knitting machine of FIG. 2A, showing the insertion of a second raising cam.

If however only some needles are to be raised with the selection device 11 whereas others are to be used to make a tuck stitch (not clearing the stitch formed during the previous travel), the configuration of FIG. 2B is used.

The selector 11 is used to raise the needles 3 to be put into operation by the jacks 4, which are moved by the contour 9 to their maximum level.

The other needles 3', corresponding to the inactivated jacks 4', encounter along their path the second raising cam 27, inserted into an angular position downstream of the first cam 26, which in this case is kept disengaged by withdrawing it outwards with radial movement.

The cam 27 has a raising contour which reaches a lower level than that of the cam 26 or attained by the jack cam 9.

At this lower level the stitch is not cleared but retained. The stitch loop on the needle opens the latch 28 but does not descend onto the needle shaft.

The needle hook 25 can also seize a new yarn at this level but, as it rises later than the needles put into operation by their jacks, the needles raised by the cam 27 can only seize yarns from the lowered yarn guides positioned more to the left than their raising point. If for example a yarn guide 24*a* is lowered, the needle 3' is not able to seize its yarn, whereas if the yarn guide 24*e* is lowered it seizes its yarn.

In the first case, during its travel the needle 3' does not form a new loop but retains only that which it already had in its hook 25, whereas in the second case the needle 3' seizes a new yarn and forms a new loop, which remains in the hook 25 together with that retained.

In both cases the needles 3—those put into operation by the jacks 4—also seize the possible second yarn presented more to the left.

Figure 2C:
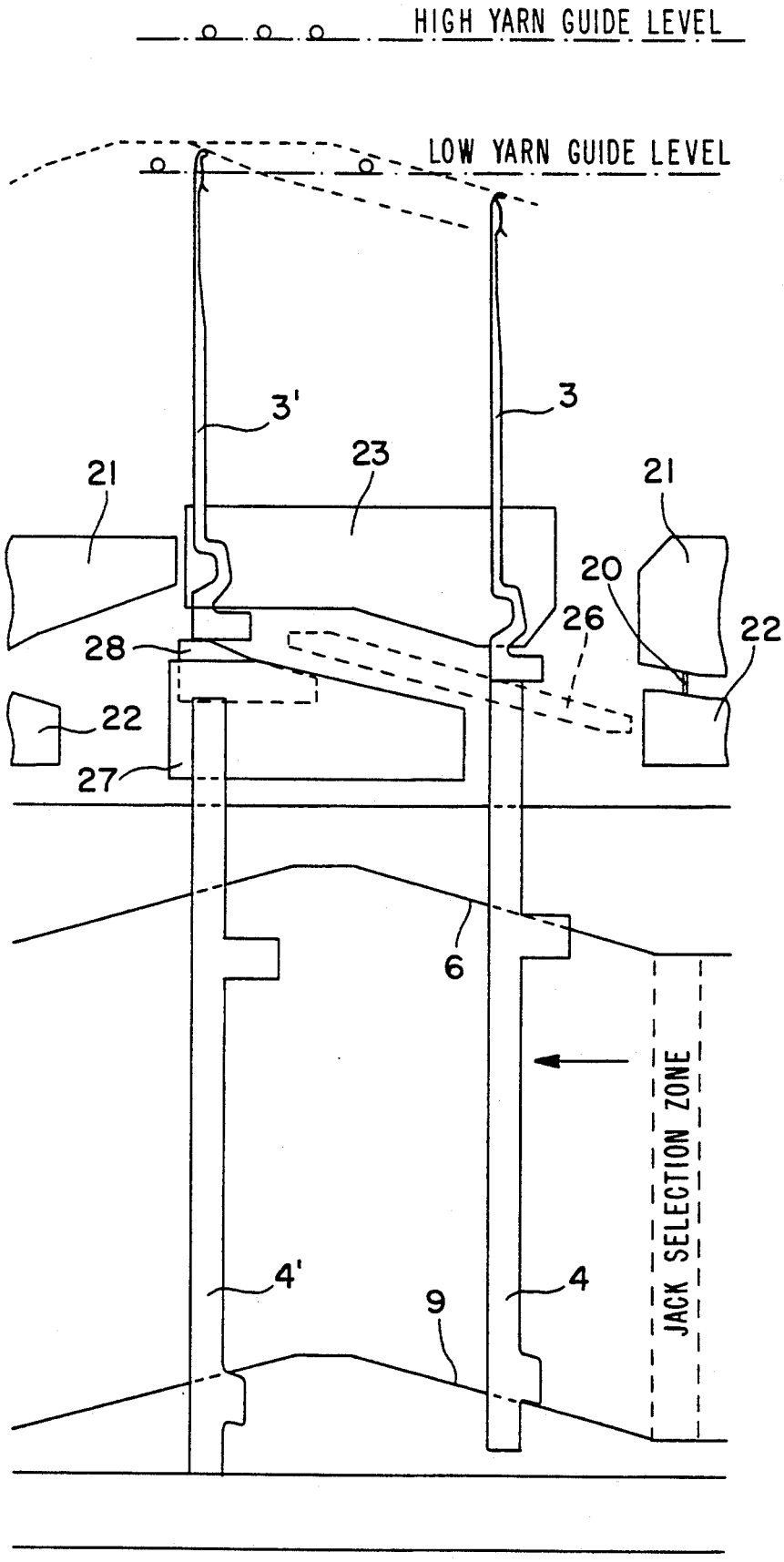
FIG. 2C PRIOR ART
FIG. 2C is a fragmentary schematic view of the prior art circular knitting machine of FIGS. 2A and 2B, showing the insertion of the second raising cam and a third raising cam, with the first raising cam in a withdrawn position.

Finally, if it is required to firstly raise only some needles with the selection device 11 and afterwards raise all the other needles to the same level, so clearing all the previously formed loops, the configuration of FIG. 2C is used.

In this configuration the cam 26 is kept disengaged, i.e. maintained radially withdrawn from the needle butts, and both the second raising cam 27 is inserted together with a third cam 28 for further raising, which operates on the cam 3' already raised by the cam 27 to the tuck stitch level, to further raise them to the unloaded stitch level.

In this case, any one of the yarn guides 24 positioned at an angular coordinate useful for feeding these needles 3' is lowered to supply a new yarn to those needles 3' which have cleared their previous loops. If not, the knitted fabric would ladder.

This configuration—on the basis of that described in relation to the yarn feeds—enables the needles 3 put into operation by the jacks to be given one or more additional yarns, for example for reinforcement, than the yarns supplied to the needles 3' raised late.

When the three cams 26, 27 and 28 are disengaged, the machine operates with the needles either in operation or at rest solely on the basis of the jack selection.

The needle operating device of the known art as heretofore described has considerable drawbacks in terms both of the device and of the procedure, and limits the performance of circular knitting machines.

It requires three cams 26, 27 and 28 and their radial approach and withdrawal mechanisms, which have to be controlled very accurately in terms both of synchronization and of radial travel. As in the case of all cams to be radially inserted, they require two-stage approach action and require the use of butts 20 of two or more different extents of projection divided into two or more separate angular sectors.

The raising contour of the cams, and in particular of the cam 26, is necessarily steep as it has to leave a certain space for locating the other two cams 27 and 28, which in their turn have for the same reason to commence their raising contour with a certain angular lag. There are therefore limitations on the allowable speed of the circular knitting machine in order not to cause collision between the butts 20 and cams 23 and 21, which could cause vibration and damaging wear.

The present invention provides a device for controlling those jacks which have not been put into operation by the selection device 11 and jacks 4.

To make characteristics and advantages of the device according to the invention apparent, it is described with reference to one embodiment thereof shown by way of non-limiting example in FIG. 3.

The machine always rotates from right to left.

According to the present invention, in place of the system comprising the three radially movable cams 26, 27 and 28, there is provided downstream of the cam/-counter-cam system 21 and 22 a single axially movable cam 30 having a raising contour as far as the unloaded stitch level, but with a smoother and less steep extension than the previously described cam 26.

According to a preferred embodiment of the invention the cam 30 occupies substantially all the angular gap available between two consecutive counter-cams 22, in order to form a smooth raising contour and ensure control of the lower position of the needles in each case. A space between the cams 30 and 22 is in any event required for needle mounting and replacement.

In place of the fixed cam/for limiting the needle raising, there is provided a more extensive fixed cam 31 which is superposed on and blends into the cam 21 to smoothly limit the upward travel of the needles.

The cam 30 can be moved axially into three positions.

The first position is that indicated by the full line at maximum level and corresponds, in terms of its function, to the configuration of FIGS. 2A and 2C. With this position the needle selection device can be inactivated, the needles then all being moved to the unloaded stitch level, as with the cams 26 or 27/28 of FIG. 2, and seize the yarn feeds which are represented to them.

There are no space problems, and hence the raising contour of the cam 30 can be less steep than the cams 26, 27 and 28 of the known art.

Figure 3:
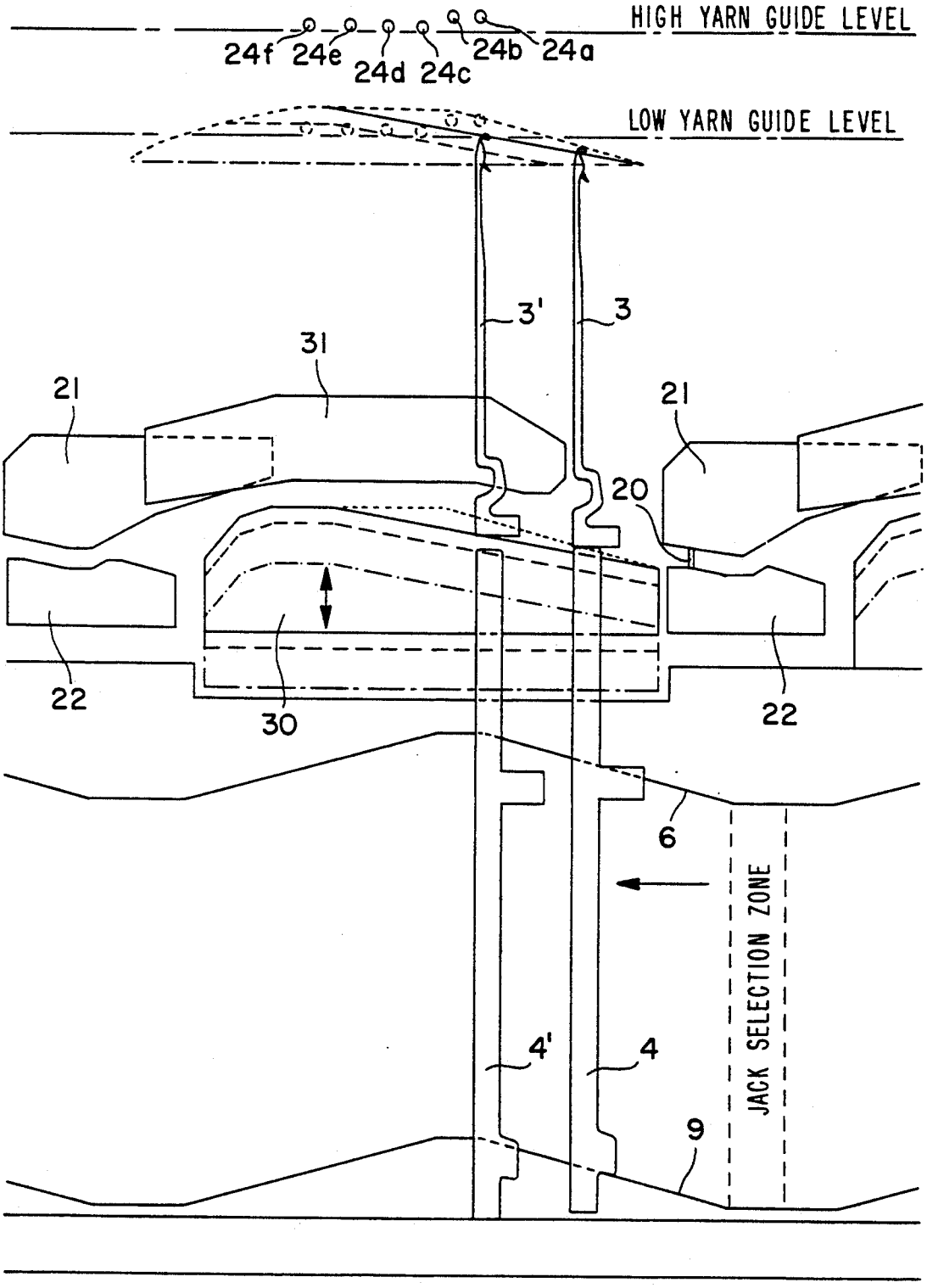
FIG. 3 is a schematic fragmentary view of a circular knitting machine incorporating the device according to the invention.

The upper part of FIG. 3 shows the band of possible trajectories of the heads of the needles 3 and 3'.

The trajectories of the needles 3 selected by the jacks is indicated by the dotted line. It is steeper and is able to seize all yarn feeds presented to it in the lowered position, by moving their yarn guide to the minimum level.

The full-line trajectory of the needles 3' not selected by the jacks 4 but corresponding to the inactivated jacks 4' corresponds instead to the full-line contour of 30 traversed by the butts 20 of the needles 3'. In this case the needles 3' unload the stitch and seize another yarn feed from the yarn guides which are presented to them in the lowered position. Generally, the yarn guides 24 most to the right are reserved for the needles 3 raised by the jacks, and the remaining yarn guides 24 are also available for the needles 3' raised by the cam 30.

The smoother contour enables the machine to work—with the needle selection inactivated—more quickly and smoothly than the configuration of FIG. 2A of the known art.

The second position is the dashed-line position at intermediate level and corresponds in terms of its function to the configuration of FIG. 2B. With this position the needles 3', which have not been selected and put into operation by their jacks, are raised to tuck stitch level and can either take or not take a new yarn, depending on whether one of the yarn guides positioned more to the left is presented to them. If it is, this yarn is also seized by the needles 3 which have traversed the dotted trajectory, and that which has been described in relation to FIG. 2B applies.

The third position, i.e. the lowest position shown by the dashed and dotted line, allows the needles not put into operation by the selection device 11 to pass low. The machine operates with the needles either working or at rest totally on the basis of the jack selection.

The positioning member for the cam 30 is analogous to that for the cams 26, 27 and 28 of the known art, and can consist for example of a three-position pneumatic cylinder.

It does not however require particular synchronization and travel precision expedients, as instead are required for the cams 26, 27 and 28.

The advantages offered by the device of the present invention consist essentially of simplification of the needle control system and greater machine productivity and reliability.

The single axially movable cam 30 replaces the three radially movable cams and their precision control members. Its less steep and softer raising contour places practically no limits on the machine speed, as instead are placed by other machine components, such as the cam system 21/22.

Whereas the cams 26, 27 and 28 of the method of the known art require, for the approach movement, the needle butts to project to different extents and be arranged in separate angular sectors, the cam 30 operates with needles all equal. If it is required to use needles with different butt projections, a number of radially superposed cams 30 can be used to give greater facility for textile modulation, without necessarily having to position the needles in different angular sectors for different butt projections.

The system for raising and lowering the cam 30 does not require special precision in terms of travel and synchronization, whereas the radial approach system for the cams 26, 27 and 28 of the known art requires considerable precision of movement, such as synchronization controlled to a thousandth of a second and travel controlled to a tenth of a millimetre, in order not to ruin the needles and cylinder. For positioning in operation in accordance with the configuration of FIG. 2C, an even more strict synchronization is required to firstly move the cam 27 into position and then the cam 28, at a distance in time equivalent to the path of just a few needle steps of the machine when rotating at full speed, and to withdraw then in the reverse order.

According to the method of the known art the changes in configuration between the various FIG. 2 can be effected only within a precise angular sector of the needle cylinder, whereas in the device of the invention the raising and lowering of the cam 30 can be effected at any feed or indeed at any moment, without any problem.

I claim:

1. A circular knitting machine comprising yarn feed stations, needles having butts, a needle selection device, jacks for moving respective needles into operation under control of said needle selection device, and a device for axially shifting needles not moved into operation by said jacks under control of said needle selection device, into a raised knitting position, a tuck stitch position, or a float position;

said device comprising an axially movable cam, said axially movable cam defining a contour and being movable to three levels corresponding to the knitting position, the tuck stitch position, and the float position, the butts of said needles not moved into operation by said jacks traversing said contour of said axially movable cam, said device being arranged in correspondence with said feed stations of said circular knitting machine, said contour raising said needles not moved into operation by said jacks with a substantial delay with respect to said needles moved into operation by said jacks under control of said needle selection device.

2. The circular knitting machine of claim 1, further comprising a needle lowering cam and a fixed counter cam superimposed on said needle lowering cam in correspondence with said axially movable cam for limiting rising strokes of said needles.

3. The circular knitting machine of claim 2, comprising two fixed counter cams, an angular gap being defined between said two counter cams, said axially movable cam entirely occupying said annular gap.

4. The circular knitting machine of claim 3, wherein said needles raised by said jacks seize yarn from said feed stations, and wherein said needles raised by said axially movable cam do not pick seize yarn fed from said feed stations.

* * * * *